US011807009B2

(12) United States Patent
Kiriishi

(10) Patent No.: US 11,807,009 B2
(45) Date of Patent: Nov. 7, 2023

(54) MAINTENANCE DEVICE AND INKJET RECORDING DEVICE

(71) Applicant: Konica Minolta, Inc., Tokyo (JP)

(72) Inventor: Kodai Kiriishi, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 22 days.

(21) Appl. No.: 17/393,817

(22) Filed: Aug. 4, 2021

(65) Prior Publication Data

US 2022/0040983 A1 Feb. 10, 2022

(30) Foreign Application Priority Data

Aug. 4, 2020 (JP) ..... 2020-132089

(51) Int. Cl.

| | |
|---|---|
| ***B41J 2/165*** | (2006.01) |
| ***B41J 2/17*** | (2006.01) |
| *B41J 2/14* | (2006.01) |
| *B41J 25/00* | (2006.01) |

(52) U.S. Cl.

CPC ..... *B41J 2/16535* (2013.01); *B41J 2/16523* (2013.01); *B41J 2/16538* (2013.01); *B41J 2/16588* (2013.01); *B41J 2/1721* (2013.01); *B41J 2/14201* (2013.01); *B41J 2002/16564* (2013.01); *B41J 2025/008* (2013.01)

(58) Field of Classification Search

CPC B41J 2/16535; B41J 2/16538; B41J 2/16588; B41J 2/14201; B41J 2002/16564; B41J 2025/008; B41J 2/16523; B41J 2/1721

See application file for complete search history.

(56) References Cited

U.S. PATENT DOCUMENTS

2011/0193913 A1* 8/2011 Cho ..... B41J 2/16535 347/25

FOREIGN PATENT DOCUMENTS

JP 2012006156 A 1/2012

* cited by examiner

*Primary Examiner* — Geoffrey S Mruk

(74) *Attorney, Agent, or Firm* — CANTOR COLBURN LLP

(57) ABSTRACT

Provided is a maintenance device that performs maintenance of a recording head with a nozzle face on which an opening of a nozzle for ink discharge is provided. The maintenance device includes a scraper that scrapes ink that adheres to the nozzle face, and an ink receiver that receives ejected ink that is ejected through the nozzle and scraped ink that is scraped off by the scraper. The ink receiver includes a first face and a second face that are each inclined with respect to a horizontal plane. The ink receiver receives the ejected ink at least on the first face of the first face and the second face, and receives the scraped ink on the second face. A flowability of ink on the second face is greater than a flowability of ink on the second face.

21 Claims, 10 Drawing Sheets

MAINTENANCE DEVICE AND INKJET RECORDING DEVICE

CROSS-REFERENCE TO RELATED APPLICATIONS

The present invention claims priority under 35 U.S.C. § 119 to Japanese Patent Application No. 2020-132089 filed on Aug. 4, 2020, the entire content of which is incorporated herein by reference.

BACKGROUND

Technological Field

The present invention relates to a maintenance device and an inkjet recording device.

Description of the Related Art

Conventionally, there have been inkjet recording devices that form an image by discharging ink from nozzles of a recording head and landing the ink onto desired positions on a recording medium. There are techniques for inkjet recording devices in which image recording actions are resumed after maintenance of a recording head to suppress deterioration of the image quality due to errors in ink discharge from nozzles. Maintenance of a recording head includes, for example, purge maintenance in which ink in a recording head is ejected from nozzles and scraping maintenance in which ink adhering to a nozzle face of the recording head (a face on which the nozzle openings are disposed) by purge maintenance is scraped off.

As a maintenance device performing purge maintenance and scraping maintenance as described above, JP 2012-006156 A discloses a device including an ink receiver that receives ink ejected from nozzles in purge maintenance and a scraper that scrapes ink adhering onto a nozzle face in purge maintenance. In JP 2012-006156 A, ink scraped off by the scraper is absorbed by an ink absorber, but scraped ink may be received by an ink receiver.

SUMMARY

However, an amount of scraped ink is usually small compared to an amount of ink ejected in purge maintenance. Such a small amount of scraped ink is received by the ink receiver, ink may not flow on inner walls and adheres thereto to stagnate. When ink stagnates in the ink receiver, it may scatter inside the inkjet recording device and lead to contamination, or may cause ink odor.

An object of the present invention is to provide a maintenance device and an inkjet recording device that can make it harder for ink to remain in an ink receiver.

To achieve at least one of the abovementioned objects, a maintenance device reflecting one aspect of the present invention performs maintenance of a recording head with a nozzle face on which an opening of a nozzle for ink discharge is provided, the maintenance device including:

a scraper that scrapes ink that adheres to the nozzle face; and an ink receiver that receives ejected ink that is ejected through the nozzle and scraped ink that is scraped off by the scraper, wherein the ink receiver includes a first face and a second face that are each inclined with respect to a horizontal plane, wherein the ink receiver receives the ejected ink at least on the first face of the first face and the second face, and receives the scraped ink on the second face, wherein a flowability of ink on the second face is greater than a flowability of ink on the second face.

To achieve at least one of the abovementioned objects, an inkjet recording device reflecting another aspect of the present invention includes:

a recording head with a nozzle face on which an opening of a nozzle for ink discharge is provided; and the maintenance device described above.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, wherein.

DETAILED DESCRIPTION OF THE EMBODIMENTS

Hereinafter, a maintenance device and an inkjet recording device according to an embodiment of the present invention will be described based on the drawings.

Figure 1:
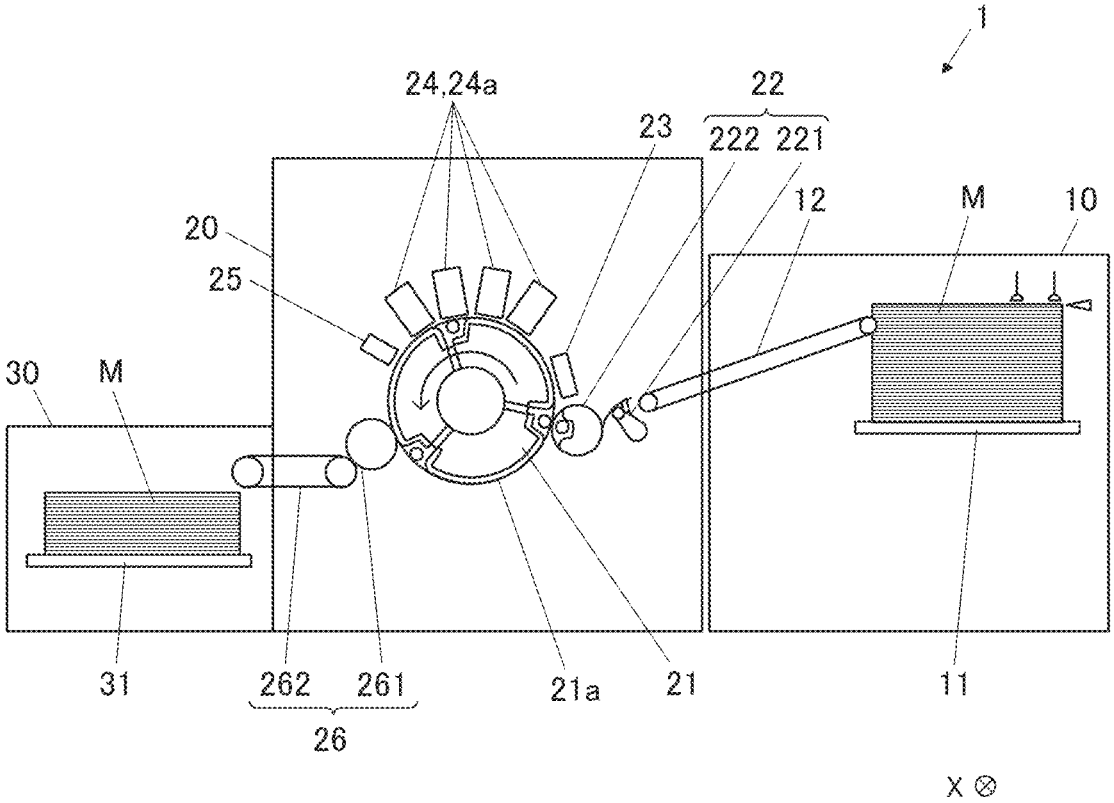
FIG. 1 shows a schematic configuration of an inkjet recording device in an embodiment of the present invention.

FIG. 1 shows a schematic configuration of an inkjet recording device 1 in an embodiment of the present invention.

Figure 11:
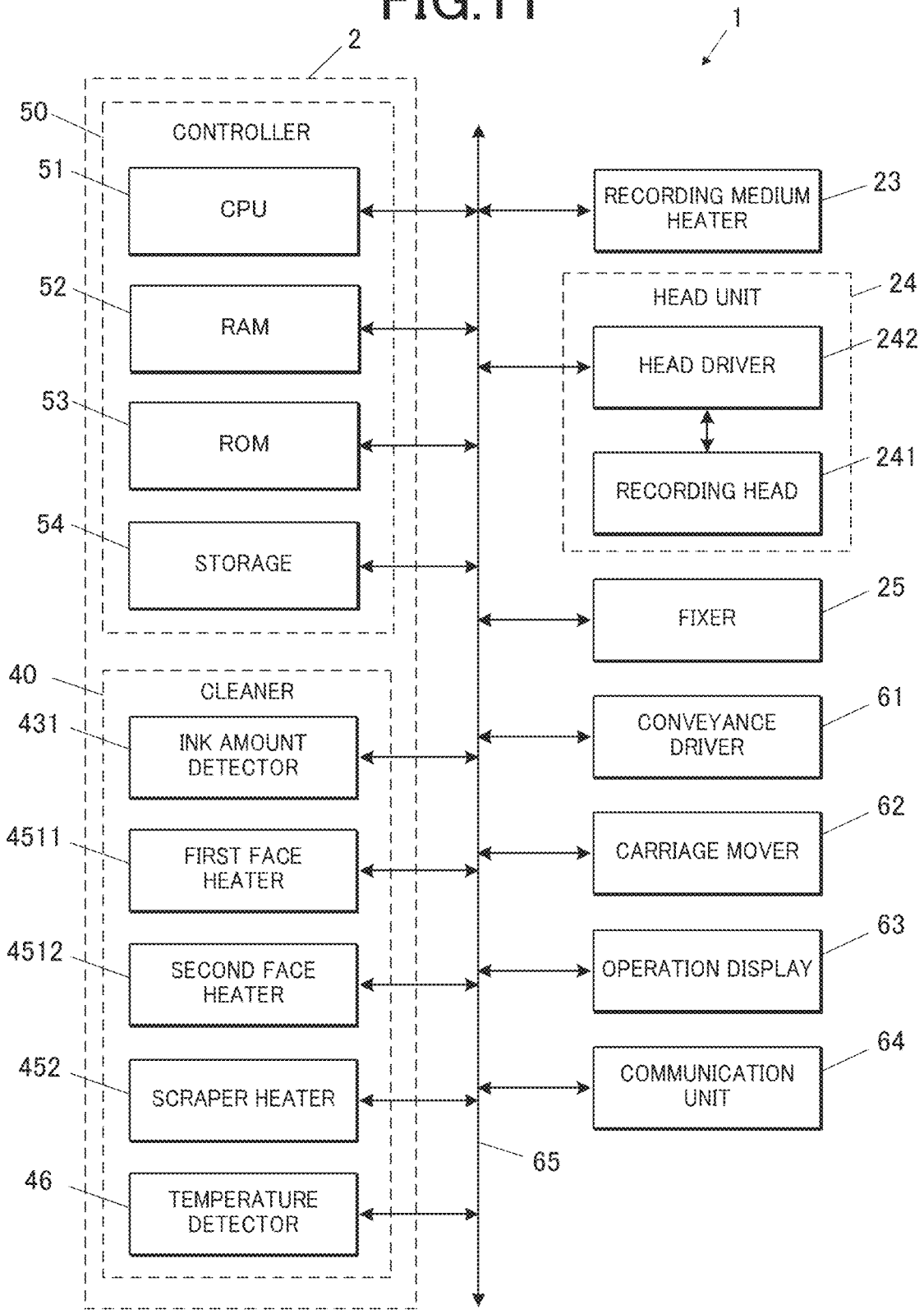
FIG. 11 is a block diagram showing a functional configuration of the inkjet recording device.

The inkjet recording device 1 includes a sheet feeder 10, an image former 20, a sheet ejector 30, a cleaner 40 (see FIG. 4), and a controller 50 (see FIG. 11). The cleaner 40 and the controller 50 together constitute a maintenance device 2 (see FIG. 11). The inkjet recording device 1 conveys a recording medium M stored in the sheet feeder 10 to the image former 20, records an image on the recording medium M at the image former 20, and conveys the recording medium M with the image to the sheet ejector 30, under the control of the controller 50. The recording medium M may be any of various media which can fix ink landed on the surface thereof such as fabric and sheet resin as well as papers including plain paper and coated paper.

The sheet feeder 10 includes a sheet feeding tray 11 that stores the recording medium M and a medium feeder 12 that conveys and feeds the recording medium M from the sheet feeding tray 11 to the image former 20. The medium feeder 12 includes an endless belt supported from the inner side by two rollers. The medium feeder 12 rotates the rollers to convey the recording medium M on the belt from the sheet feeding tray 11 to the image former 20.

The image former 20 includes, for example, a conveyance drum 21, a hand-over unit 22, a recording medium heater 23, head units 24, a fixer 25, and a deliverer 26.

The conveyance drum 21, which has a cylindrical shape, holds the recording medium M on its outer circumference that is a conveyance surface 21*a*, rotates around the rotation axis extending in the X direction perpendicular to the drawing plane in FIG. 1, and thereby conveys the recording medium M in the conveyance direction on the conveyance surface 21*a*. The conveyance drum 21 includes hooks 211 (see FIG. 3) and an air sucker 212 (see FIG. 3) for holding the recording medium M on the conveyance surface 21*a*. The recording medium M is held on the conveyance surface 21*a* by the hooks 211 pressing the ends and the air sucker 212 suctioning the recording medium M on the conveyance surface 21*a*.

The conveyance drum 21 is connected to a conveyance drum motor (not shown) for rotating the conveyance drum 21 and is rotated by an angle proportional to the rotation amount of the conveyance drum motor.

The hand-over unit 22 feeds the recording medium M conveyed by the medium feeder 12 in the sheet feeder 10 to the conveyance drum 21. The hand-over unit 22 is arranged between the medium feeder 12 in the sheet feeder 10 and the conveyance drum 21. The hand-over unit 22 holds and receives the recording medium M conveyed from the medium carrier 12 at one end with a swing arm 221 to feed the recording medium M to the conveyance drum 21 via a hand-over drum 222.

The recording medium heater 23, which is arranged between the handover drum 222 and the head units 24, heats the recording medium M conveyed by the conveyance drum 21 so that the temperature of the recording medium M falls within a predetermined temperature range. For example, the recording medium heater 23 includes an infrared heater or the like. The heater generates heat when electricity is applied to the infrared heater based on a control signal from the controller 50.

Each of the head units 24 includes multiple recording heads 241 (see FIG. 2) and a carriage 24*a* on which the recording heads 241 are mounted. The head units 24 record an image as the head units 24 discharges ink to the recording medium M from an ink discharge surface (a nozzle face 241*a* on which openings of nozzles N of the recording head 241 described later (see FIG. 2)) opposed to the conveyance surface 21*a* of the conveyance drum 21 at suitable timing in accordance with rotation of the conveyance drum 21 on which the recording medium M is held. The head units 24 are arranged so that the nozzle face 241*a* is at a predetermined distance away from the conveyance surface. In the inkjet recording device 1 of the embodiment, four head units 24, which correspond respectively to four different color inks of yellow (Y), magenta (M), cyan (C) and black (K), are aligned at predetermined intervals in the order of Y, M, C and K from the upstream in the conveyance direction of the recording medium M.

Figure 2:
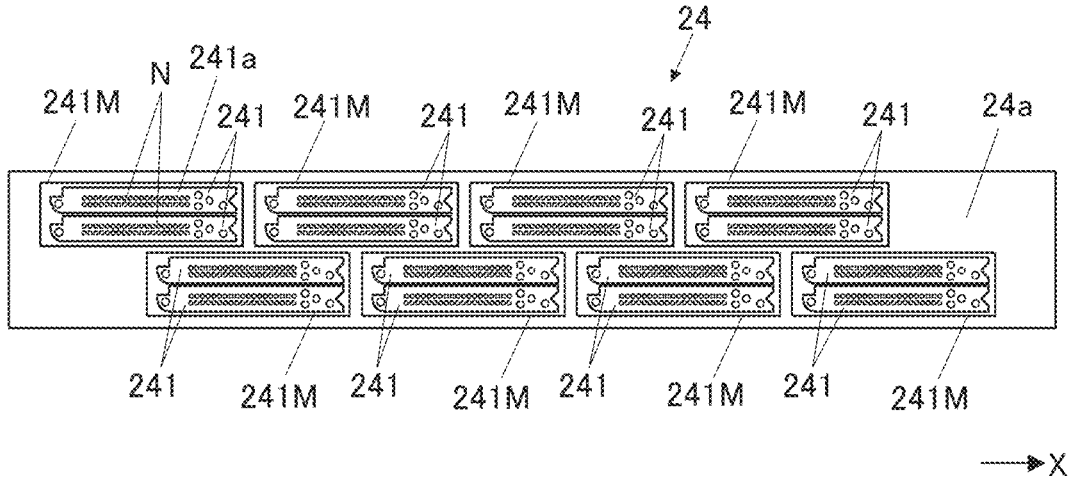
FIG. 2 is a schematic diagram showing a configuration of a head unit.

FIG. 2 is a schematic diagram showing a configuration of a head unit 24. FIG. 2 is a plan view of the entire head unit 24 showing a side opposite to the conveyance surface 21*a* of the conveyance drum 21.

The head unit 24 includes 16 recording heads 241 each having nozzle rows of nozzles N arranged in the X direction (that is, in the width direction orthogonal to the conveyance direction). The 16 recording heads 241, of which each two are paired, constitutes 8 head modules 241M. The positions in the X direction of the nozzle rows of each of the head modules 241M are adjusted so that the positions of the nozzles does not overlap in the X direction. The arrangement direction of the nozzles N in each of the recording heads 241 is not limited to the X direction, and may be a direction intersecting the conveyance direction at an angle other than a right angle. The number of the recording heads 241 in the head unit 24 is not limited to 16, and may be modified according to the image-recording width or the like, for example.

Each of the head modules 241M fits into an opening provided on a supporting board at the bottom of the carriage 24*a*, and is supported by the supporting board in a state where the nozzle face 241*a* of the recording heads 241 is exposed from the bottom surface of the supporting board (the surface facing the conveyance drum 21). The eight head modules 241M are arranged in a staggered pattern to constitute a line head so that the arrangement ranges in the X direction of the head modules 241M partially overlap with one another in a positional relation that allows the ranges of ink discharge from the nozzles N to be continuous in the X direction.

The arrangement range of the nozzles N in the head unit 24 in the X direction covers the width in the X direction of the area in which images are recordable on the recording medium M conveyed by the conveyance drum 21. When recording an image, the head unit 24 is used in a fixed position, and ink is successively discharged at different positions in the conveyance direction at predetermined intervals (conveyance direction intervals) with the recording medium M is being conveyed. The head unit 24 thereby records an image by the single-path method.

The ink discharge mechanism for discharging ink from each nozzle N is not limited, but a piezoelectric type may be used. The shear mode and vent mode is known as an ink discharge mechanism of the piezoelectric type. In the shear-mode ink discharge mechanism, a shear-mode displacement is generated in a piezoelectric element on a wall surface of a pressure chamber communicating to the nozzle N to change ink pressure in the pressure chamber, and ink is thereby discharged. In the vent-mode ink discharge mechanism, a piezoelectric element fixed on a vibration plate that forms a pressure chamber wall is deformed to change ink pressure in the pressure chamber, and ink is thereby discharged.

The ink used in the head unit 24 for image recording has a property of changing its phase between a gel state and a sol state depending on the temperature. Here, the gel state is defined as a phase of a solid, and the sol state as a phase of a liquid. An example of the composition of such ink is a composition mainly composed of a polymerizable compound and a photopolymerization initiator with gelling agent added at a few percent.

As the gel-state ink is heated and its temperature is raised, its viscosity starts to remarkably decrease over the solidification temperature specific to the ink (for example, 70° C.), and the phase of the ink is changed to the sol-state. On contrary, as the temperature of the sol-state ink is lowered, the ink viscosity starts to remarkably increase below the gelation temperature specific to the ink (for example, 50° C.), and the phase of the ink is changed to the gel-state.

The head unit 24 includes an ink heater not shown in the drawings that heats the ink before being supplied to the recording head 241 and ink supplied to the recording head 241. The recording head 241 discharges the ink heated by the ink heater and transformed to the sol-state from the nozzles N. The ink discharged from the nozzles N and landed on the recording medium M is cooled and quickly changes its phase to the gel-state.

The ink used in this embodiment has a property of being cured by irradiation with ultraviolet rays. That is, in the inkjet recording device 1 of this embodiment, the ink in the sol-state is discharged onto the recording medium M placed on the conveyance surface 21*a*, and is cooled to be transformed to the gel-state on the recording medium M. Thereafter, the ink is irradiated with ultraviolet rays to be cured, and is thereby fixed onto the recording medium M.

The carriage 24*a* of each of the head units 24 is separately movable in the X direction.

Figure 3:
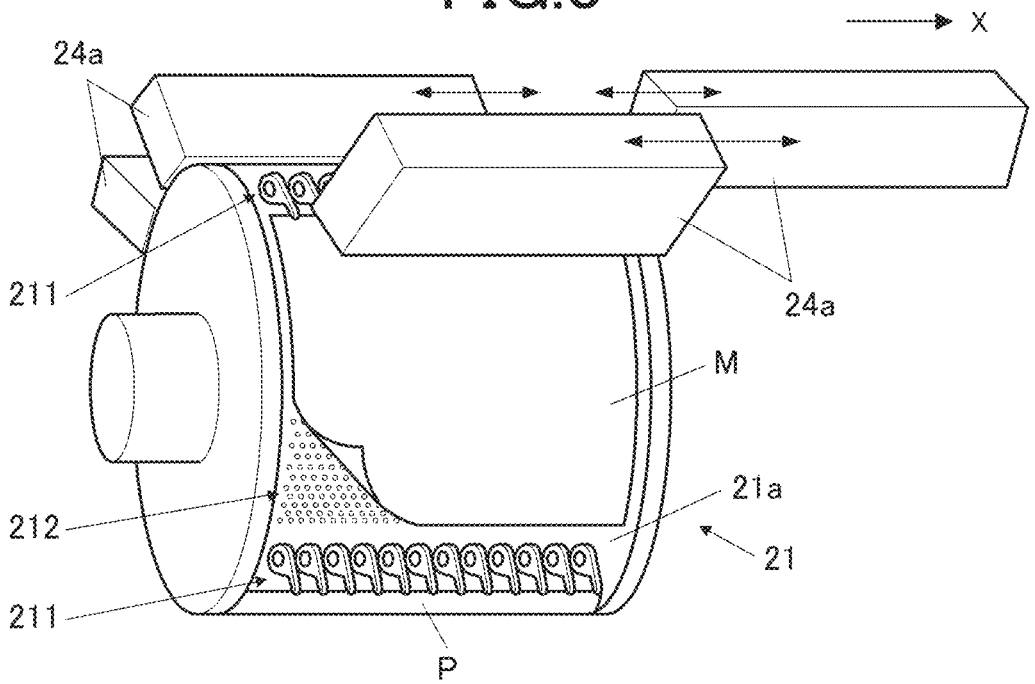
FIG. 3 shows an example of how carriages are moved in the X direction.

FIG. 3 shows an example of how the carriages 24*a* are moved in the X direction.

Figure 4:
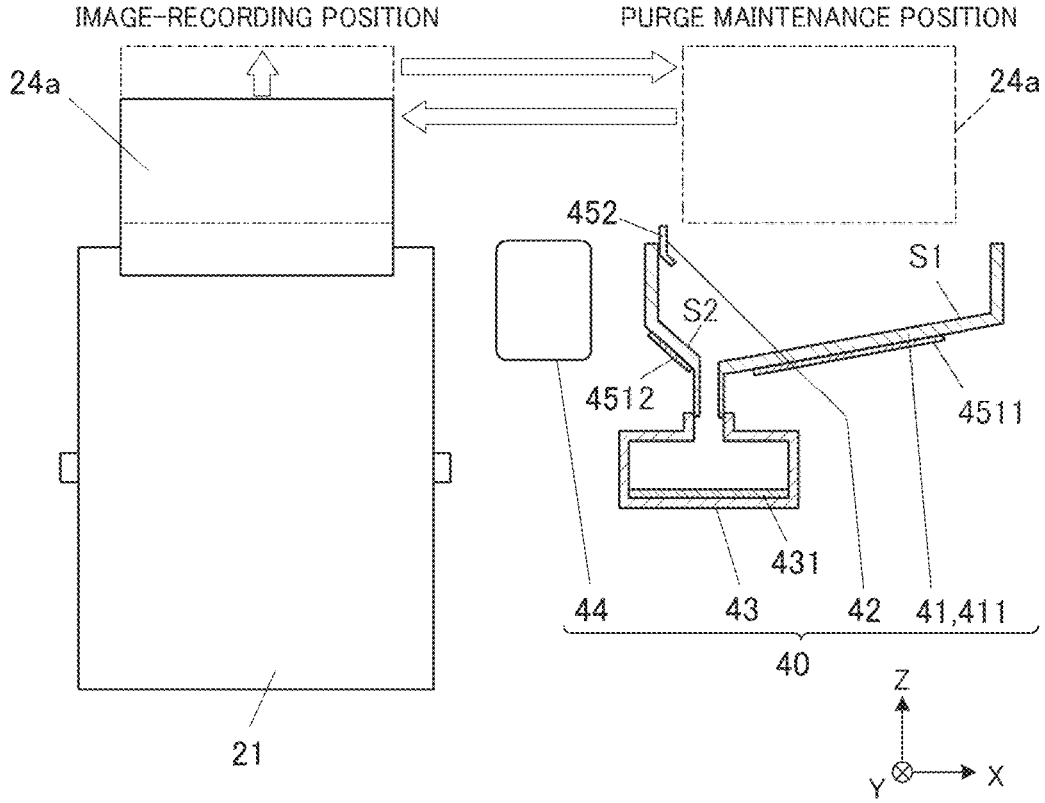
FIG. 4 shows a movable range of the carriage in the X direction.

FIG. 4 shows a movable range of the carriage 24*a* in the X direction.

The carriage 24*a* is driven by the carriage mover 62 (see FIG. 11) and is thereby moved in the X direction between an image-recording position and a purge maintenance position, as shown in FIG. 3 and FIG. 4.

The image-recording position is where the nozzle face 241*a* of the recording head 241 faces the conveyance surface 21*a* of the conveyance drum 21. The carriage 24*a* is at the image-recording position when discharging the ink onto the recording medium M on the conveyance surface 21*a* to record an image. The carriage 24*a* can be moved from the image-recording position to the purge maintenance position as the carriage 24*a* is raised in a direction separating from the conveyance surface 21*a* and then moved in the +X direction.

The purge maintenance position is where the carriage 24*a* is arranged during the purge maintenance to eject ink from the nozzles N of the recording head 241. In the purge maintenance, ink is continuously discharged from the nozzles N by changing the ink pressure in the pressure chambers communicating with the nozzles N. This makes it possible to eject bubbles and foreign materials contained in the ink in the recording head 241 out with the ink. The purge maintenance is not limited to this example, and may be a method of ejecting ink from the nozzles forcibly by increasing pressure of supplying ink to the recording head 241 (pressure purge).

The cleaner 40 is arranged vertically below the carriage 24*a* at the purge maintenance position. The cleaner 40 includes an ink receiver 41, scrapers 42, an ink storage 43, and an ink absorber 44.

Figure 5:
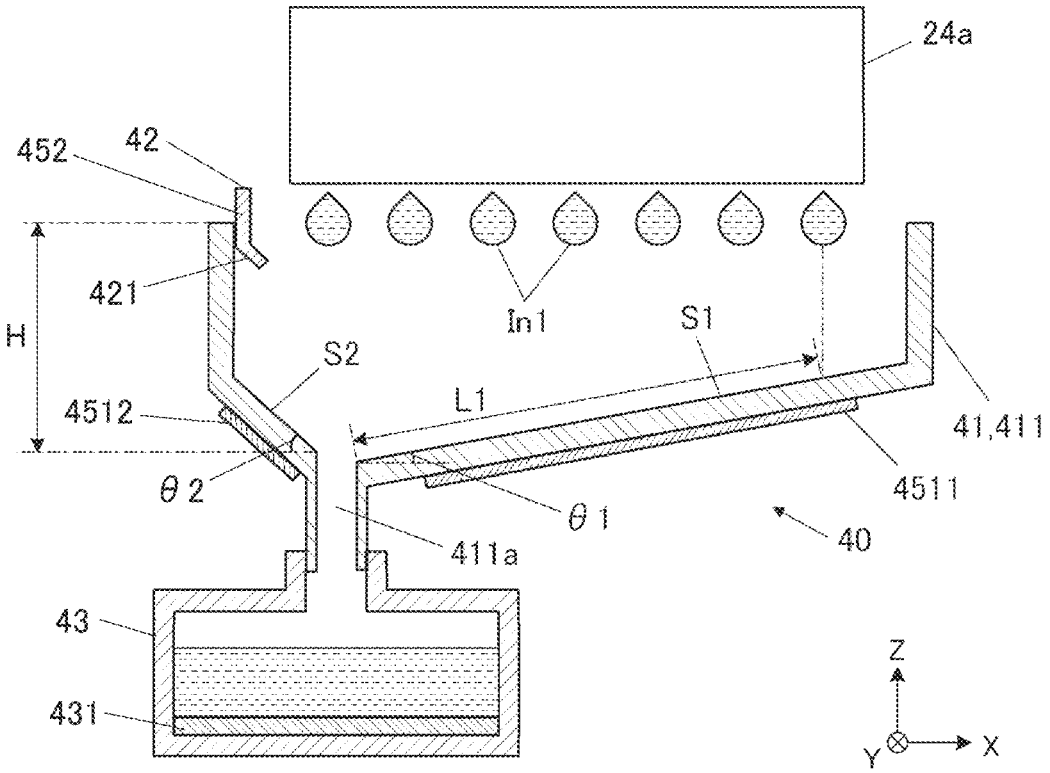
FIG. 5 shows a cross-sectional view of a cleaner during purge maintenance.

FIG. 5 shows a cross-sectional view of the cleaner 40 during the purge maintenance.

The ink receiver 41, which includes an ink tray 411 with a first face S1 and a second face S2 each inclined with respect to the horizontal plane, receives, on the first face S1 and the second face S2, ejected ink In1 ejected from the nozzles N in the purge maintenance. In the cross-sectional view of FIG. 5, the first face S1 is a face on the +X direction side among the bottom faces of the ink tray 411, and the second face S1 is a face on the −X direction side among the bottom faces of the ink tray 411. The ejected ink In1 may be received on the first face S1 only. The material of the ink tray 411 may be aluminum, for example, but is not limited to this example.

In this embodiment, one ink tray 411 is provided commonly for the four carriages 24*a*, but the present invention is not limited to this example. An ink tray 411 may be provided separately for each of the carriages 24*a*.

An outlet 411*a* through which ink having flown on the first surface S1 and the second face S2 flows in is provided at the bottom of the ink tray 411. The ink dropping (landed) on the first face S1 and the second face S2 flows on the first face S1 and the second face S2 downward by the gravity and flows into the outlet 411*a*.

An inclination angle θ2 between the second face S2 and the horizontal plane is larger than an inclination angle θ1 between the first face S1 and the horizontal plane. This makes the flowability of ink on the second face S2 greater than that on the first face S1.

Here, it is meant by "the flowability of ink being great" that the amount of ink remaining in a predetermined range of distance from the spot where ink is dropped (ink drop spot) is comparatively small after a predetermined time after the same amount of the same ink is dropped. Here, the "predetermined time" is not limited, but may be one to several seconds, for example.

Thus, on the second face S2 having a greater flowability of ink than the first face S1, the dropped ink is less likely to remain than on the first face S1. Generally, as the amount of ink dropped on an inclined surface is smaller, the ink is harder to flow on the inclined surface. However, as the flowability is comparatively great on the second face S2, the ink does not remain on the second face S2 but flows downward even when a small amount of ink that would be remaining on the first face S1 is dropped on the second face S2.

However, a flowability on the first face S1 allows the ink in an amount ejected from the nozzles N in the purge maintenance to flow downward almost without remainder. Most of the ejected ink In1 in the purge maintenance is dropped on the first face S1 and flows downward on the first face S1 into the outlet 411*a*. Part of the ink In1 dropped on the second face S2 also flows downward on the second face S2 into the outlet 411*a*.

The inclination angle θ1 is constant regarding the entire first face S1 and the angle θ2 is constant regarding the entire second face S2, but the present invention is not limited to this example. In the case where the inclination angle is not constant regarding the first face S1 and/or the inclination angle is not constant regarding the second face S2, the first face S1 and the second face S2 are provided so that the maximum value of the inclination angle of the first face S1 is larger than the minimum value of the inclination angle of the second face S2.

The ink tray 411 has the first face heater 4511 that performs a heating action to heat the first face S1 on the other side of the first face S1, and the second heater 4512 that performs a heating action to heat the second face S2 on the other side of the second face S2. The first face heater 4511, which includes a heating wire that is routed along the first face S1, heats the first face S1 at a part where the ejected ink In1 is in contact by electrifying the heating wire under the control of the controller 50. The first face heater 4511 may heat the entire first face S1. The second face heater 4512, which includes a heating wire that is routed along the second face S2, heats the second face S2 at a part where the ejected ink In2 is in contact by electrifying the heating wire under the control of the controller 50. The second face heater 4512 may heat the entire second face S2. The heating actions on the first face heater 4511 and the second face heater 4512 are controlled separately and independently by the controller 50. In the case where the ink tray 411 is made of a material that does not easily transfer heat such as a resin, a plate-like member with a high thermal conductivity such as an aluminum is preferably provided between the ink tray 411 and the first face heater 4511 and between the ink tray 411 and the second heater 4512. The first face heater 4511 and the second face heater 4512 correspond to a "first heater."

The heating temperatures in the heating actions by the first face heater 4511 and the second face heater 4512 are controlled by the controller 50 so as to fall within a predetermined temperature range.

Specifically, the temperatures of the first face S1 and the second face S2 heated by the heating actions are higher than the solidification temperature of ink.

The heating temperatures in the above heating actions are set within a range lower than both the temperature at which ink is thermally cured and the maximum temperature that keeps the ink odor within a predetermined allowable range. Generally, the higher the temperature is, the higher the ink odor is. As the ink temperature is within a range lower than the predetermined maximum temperature, the ink odor may be suppressed within the predetermined range.

The scrapers 42 are provided at the upper end of the peripheral wall on the −X direction side of the ink tray 411. The number of the scrapers 42 is four, one for each of the carriages 24*a*. However, the number of the scrapers 42 is not limited to this example, and one scraper 42 may be commonly provided for all the four carriages 24*a*.

Each of the scrapers 42 is a blade-like member that has a length equal to or longer than the width of the recording head 241 in the Y direction of the nozzles surface 241*a*. The material of the scraper 42 is not limited, but may be any of various kinds of resins or metals.

The scraper 42 scrapes and removes the ink ejected from the nozzles N and adhering to the nozzle face 241 in the purge maintenance.

Figure 6:
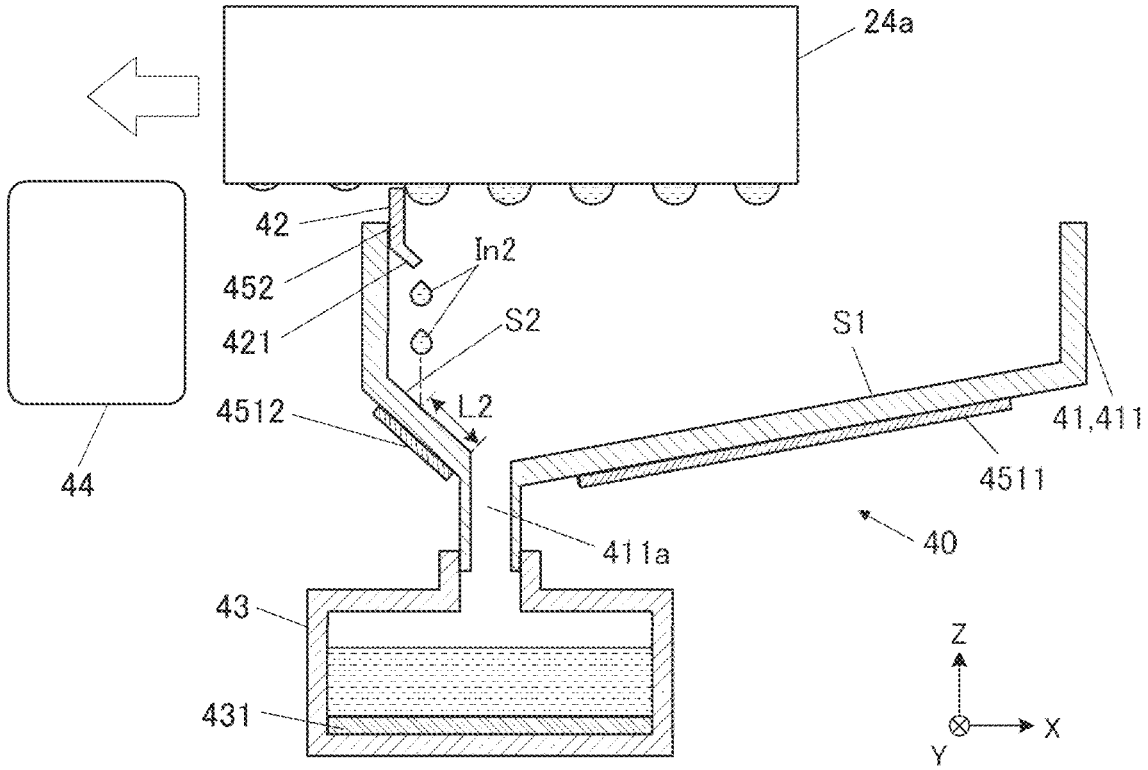
FIG. 6 shows a cross-sectional view of the cleaner during an ink scraping action by a scraper.

FIG. 6 shows a cross-sectional view of the cleaner during an ink scraping action by the scraper 42.

The end of the scraper 42 in the +Z direction is arranged at a position where the scraper 42 does not touch the nozzle face 241*a* but touches the ink adhering to the nozzle surface 241*a* when the carriage 24*a* moves in the −X direction from the purge maintenance position. As shown in FIG. 6, when the nozzle face 241*a* moves in the −X direction with the carriage 24*a*, the end of the scraper 42 approaches the nozzle face 241*a* and the ink adhering to the nozzle face 241*a* passes from the end of the scraper 42 to the lateral surface of the scraper 42. The ink is thereby scraped off and removed from the nozzle face 241*a*. That is, the scraper 42 scrapes off the ink on the nozzle face 241*a* without touching the nozzle face 241*a*.

A receiving arm 421 for adjusting the drop spot of the scraped ink In2 is attached at the lower end of the scraper 42. The receiving arm 421 transmits the scraped ink In2 scraped off by the scraper 42 along itself and drops the ink In2 at a predetermined ink drop spot on the second face S2. The scraped ink In2 that is dropped in this way is received by the second face S2 of the ink tray 411.

The amount of the scraped ink In2 is usually much smaller than the amount of the ink In1 ejected in the purge maintenance. However, as the inclination angle θ2 of the second face S2 is larger than the inclination angle θ1 of the first face S1, the flowability of ink on the second surface S2 is greater than that on the first face S1. Thus, when a small amount of the scraped ink is dropped on the second face S1, it is possible to cause the scraped ink In2 flow downward almost without remainder. The scraped ink In2 that has flown downward on the second face S2 flows into the outlet 411*a*.

The scraper 42 has the scraper heater 452 that heats the scraper 42. The scraper heater 452, which includes a heating wire that is embedded inside the heater 42, heats the scraper 42 by electrifying the heating wire under the control of the controller 50. The scraper heater 452 may be attached on the back side of the scraper 42, which is the face opposite to the face on which the scraped ink In2 flows. The temperature of heating of the scraper 42 by the scraper heater 452 is higher than the solidification temperature of ink. The heating temperature is set within a range lower than both the temperature at which ink is thermally cured and the maximum temperature that keeps the ink odor within a predetermined allowable range. The materials of the scraper 42 and the receiving arm 421 are desirably a material with a high thermal conductivity such as an aluminum so as to increase the heating efficiency of the scraper heater 452. The scraper heater 452 corresponds to a "second heater."

Figure 7:
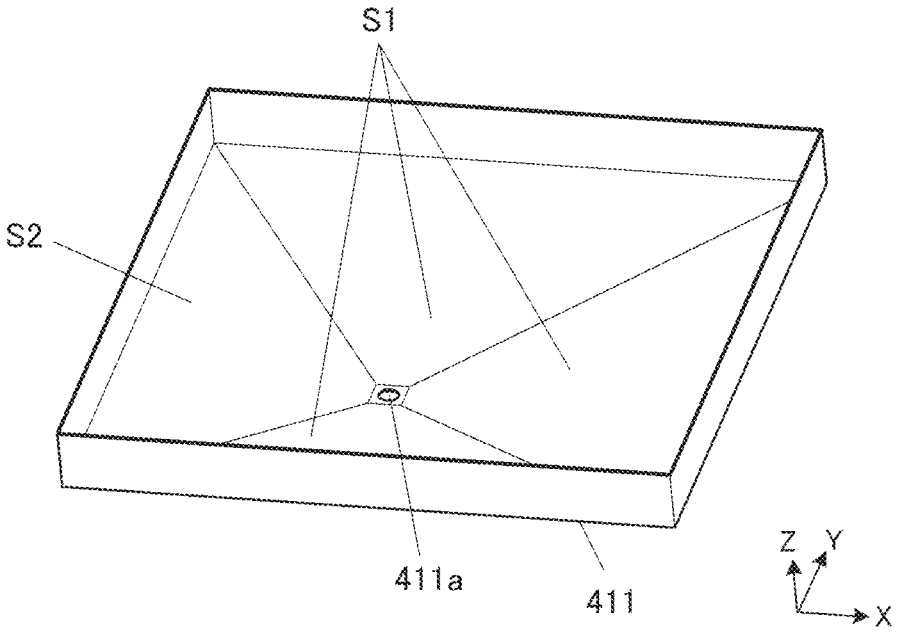
FIG. 7 shows a perspective view of an ink tray.

FIG. 7 shows a perspective view of the ink tray 411.

Figure 8:
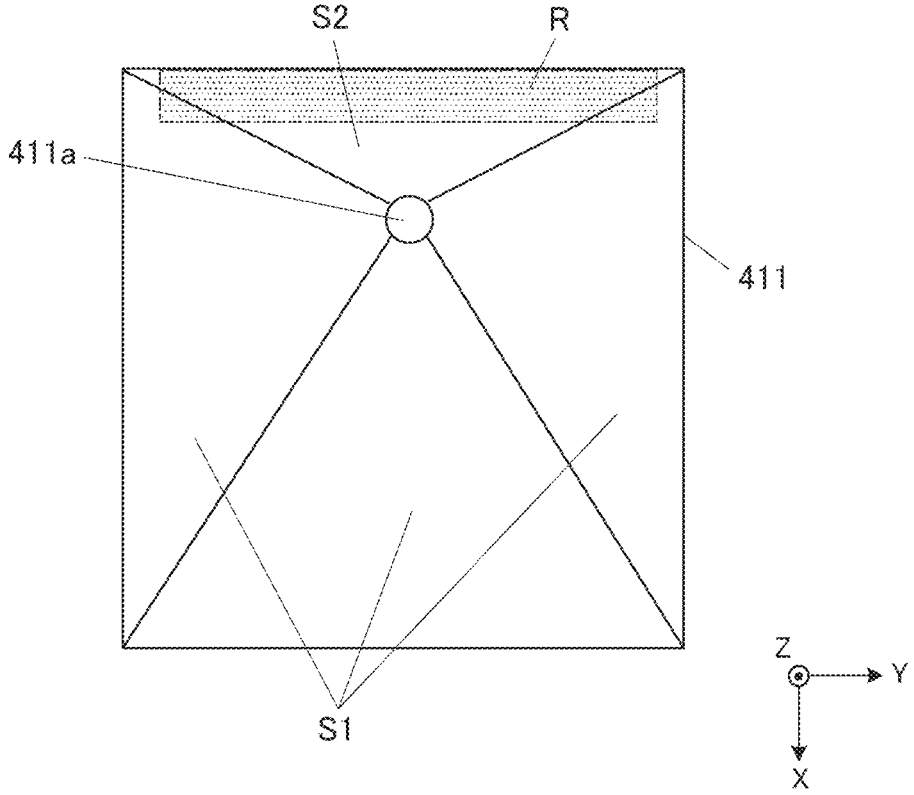
FIG. 8 shows a plan view of the ink tray viewed from the +Z direction.

FIG. 8 shows a plan view of the ink tray 411 viewed from the +Z direction.

As shown in FIG. 5 to FIG. 8, the outlet 411*a* of the ink tray 411 is arranged within the half of the ink tray 411 on the side with the scraper 42 (the −X direction side) in the direction of the relative movement of the nozzle face 241*a* and the scraper 42 scraping off the ink adhering to the nozzle face 241*a* (the X direction). This makes it possible to make the inclination angle θ2 of the second face S2 larger than the inclination angle θ1 of the first face S1. It is also possible to make the maximum value L2 of the length of the flow path of the scraped ink In2 on the second face S2 (FIG. 6) smaller than the maximum value L1 of the length of the flow path of the ejected ink In1 on the first face S1 (FIG. 5). As described above, it is possible to obtain an effect of suppressing the problem of the remaining ink In2 on the second face S2 by shortening the flow path of the scraped ink In2 on the second face S2.

The ink tray 411 in FIG. 7 has a pair of rectangular side walls parallel to the X direction, a pair of rectangular side walls parallel to the Y direction, and four bottom faces in a shape of a substantial triangle with the lower edge of each side wall as a base and the outlet 411*a* as an apex. A bottom face conjoined with the side wall on the −X direction side is the second face S2 and the remaining three of the bottom faces are the first face S1. With such a shape as described above, the inclination angle θ2 of the second face S2 is larger than the inclination angle θ1 of the first face S1. The maximum value L2 of the length of the flow path of the scraped ink In2 on the second face S2 is smaller than the maximum value L1 of the length of the flow path of the ejected ink In1 on the first face S1.

The area R shown in FIG. 8 includes an area of the second face S2 where the scraped ink In2 is dropped, and is connected to a position of joint with the lateral face on the −X direction side. The power density related to the heating actions by the first face heater 4511 and the second face heater 4512 is larger in the area R than in the remaining area. Specifically, the density of arrangement of the heating wire in the area R is larger than that in the remaining area. This makes it possible to heat the spot where the scraped ink 1*n*2 is dropped and the joint portion with the side wall where heat is easily lost. For example, the heating temperature in the area R may be higher than in the remaining area. In the case where the area R cannot be heated enough by adjusting the power density due to a large amount of heat lost from the side wall, the material of the thermal conduction path from the second face heater 4512 to the area R may be changed to a material with a higher thermal conductivity. Alternatively, a heater that heats the side wall may be provided.

Figure 9:
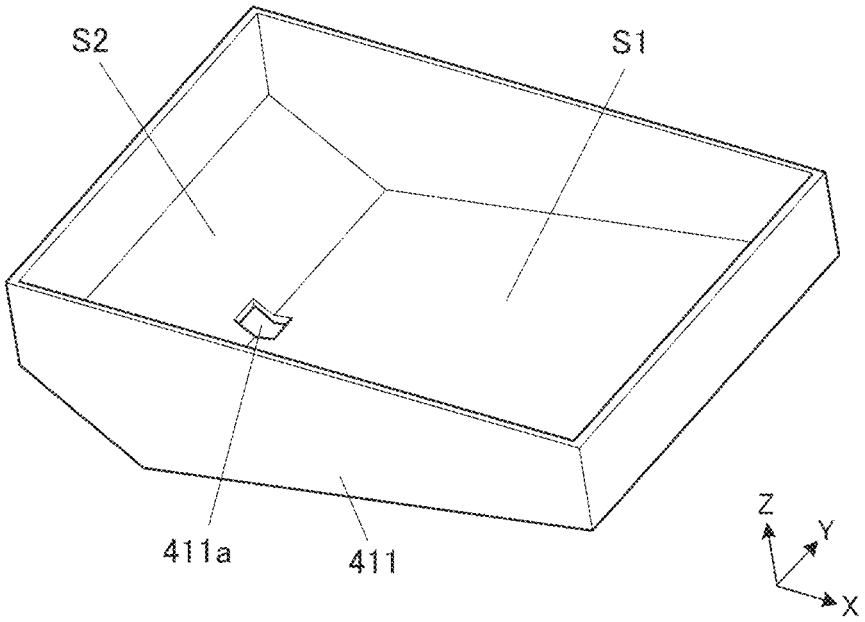
FIG. 9 shows another example of a perspective view of the ink tray.

FIG. 9 shows another example of a perspective view of the ink tray 411.

As shown in FIG. 9, the bottom faces of the ink tray 411 may be composed of one plate constituting the first face S1 and another plate constituting the second face 2 that are conjoined with each other. Also in that case, the outlet 411*a* is arranged within the half of the ink tray 411 on the side with the scraper 42 (the −X direction side) in the X direction. This makes it possible to make the inclination angle θ2 of the second face S2 larger than the inclination angle θ1 of the first face S1. It is also possible to make the maximum value L2 of the length of the flow path of the scraped ink 1*n*2 on the second face S2 smaller than the maximum value L1 of the length of the flow path of the ejected ink In1 on the first face S1.

Figure 10:
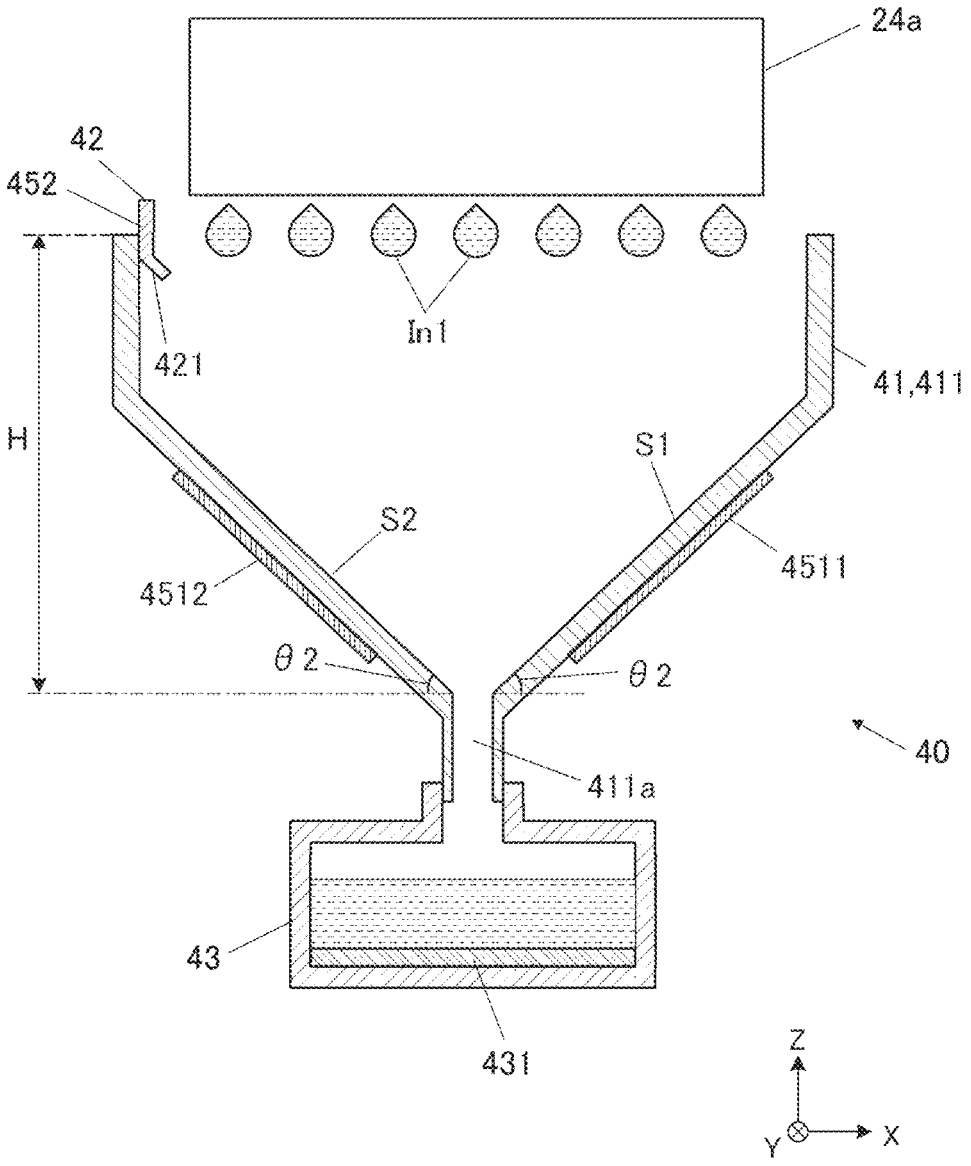
FIG. 10 shows the cleaner in a comparative example.

With such shapes of the ink tray 411 as shown in FIG. 4 to FIG. 9, the flowability of ink on the second face S2 can be improved while the height H of the ink tray 411 (FIG. 5) is suppressed. That is, the height H f the ink tray 411 can be adequately small, for example, compared to a comparative example (FIG. 10) that has the outlet 411*a* at the center of the ink tray 411 and the inclination angles of the first face S1 and the second face S2 are equally θ2.

As shown in FIG. 5 and FIG. 6, the outlet 411*a* of the ink tray 411 is connected to the ink storage 43. The ink storage 43 stores ink that is received by the ink tray 411 and flows into the outlet 411*a*. The ink amount detector 431 that detects the amount of ink stored in the ink storage 43 is provided at the bottom of the ink storage 43. The ink amount detector 431 in this embodiment is a load cell that detects the weight of the stored ink. However, the present invention is not limited to this example, and the ink amount detector 431 may detect the height of the liquid level of the ink.

The ink absorber 44 shown in FIG. 4 and FIG. 6 is arranged at a position where the ink absorber 44 is in contact with the nozzle face 241*a* when the carriage 24*a* returns from the purge maintenance position to the image-recording position. The ink absorber 44 absorbs the ink remaining in the nozzle face 241 without being scraped off by the scraper 42 and removes the ink from the nozzle face 241*a* by contacting the nozzle face 241*a*. The material of the ink absorber 44 is not particularly limited, but may be cloth, sponge, or the like, for example.

In FIG. 1, the fixer 25 includes an ultraviolet irradiator arranged over the width of the conveyance drum 21 in the X direction. The fixer 25 emits ultraviolet rays from the ultraviolet irradiator toward the recording medium M placed on the conveying drum 21 to harden and fix the ink discharged onto the recording medium M. The ultraviolet irradiator of the fixer 25 is arranged between the position of the head unit 24 and the position of a hand-over drum 261 of the deliverer 26 with regard to the conveyance direction so as to face the conveyance surface.

The deliverer 26 includes a belt loop 262 which is supported by two rollers from inside and a cylindrical delivery drum 261 for handing over the recording medium M from the conveyance drum 21 to the belt loop 262. The deliverer 26 conveys the recording medium M received from the conveyance drum 21 onto the belt loop 262 via the hand-over drum 261 and feeds the recording medium M to the sheet ejector 30 via the belt loop 262.

The sheet ejector 30 includes a plate-shaped sheet ejection tray 31 on which the recording medium M sent from the image former 20 by the deliverer 26.

FIG. 11 is a block diagram showing a functional configuration of the inkjet recording device 1.

The inkjet recording device 1 includes the recording medium heater 23, the head units 24 each including the recording head 241 and the head driver 242, the fixer 25, the cleaner 40 including the ink amount detector 431, the first face heater 4511, the second face heater 4512, the scraper heater 452, and a temperature detector 46, the controller 50, a conveyance driver 61, a carriage mover 62, an operation/display interface 63, a communication unit 64, and a bus 65. The cleaner 40 and the controller 50 constitutes the maintenance device 2. Hereinafter, the components already described are not described.

The controller 50 centrally controls the overall operations of the inkjet recording device 1 and the maintenance device 2. The controller 50 includes a CPU 51 (central processing unit), a RAM 52 (random access memory), a ROM 53 (read only memory), and a storage 54.

The CPU 51 reads a variety of control programs and setting data stored in the ROM 53, stores them in the RAM 52, and performs a variety of computation processing by executing the programs.

The RAM 52 provides a working memory space for the CPU 51 and stores temporary data. The RAM 52 may includes a non-volatile memory.

The ROM 53 stores a variety of control programs to be executed by the CPU 51, setting data, and the like. A rewritable non-volatile memory such as a flash memory may be used instead of the ROM 53.

The storage 54 stores print jobs input from an external device via the communication unit 64, image data of images to be recorded concerning the print jobs. An hard disk drive (HDD) is used as the storage 54, for example. A dynamic random access memory (DRAM) or the like may also be used in combination.

The head driver 242 supplies a drive signal that deforms the piezoelectric elements in correspondence with image data at appropriate timings to the inkjet head 241 to eject ink in an amount corresponding to pixel values of the image data from the nozzles N of the inkjet head 241.

The ink amount detector 431 of the cleaner 40 obtains detection data corresponding to the amount of the ink stored in the ink storage 43 and outputs the data to the controller 50.

The first face heater 4511, the second face heater 4512, and the scraper heater 452 electrify the heating wires based on the control signals from the controller 50 to heat the first face S1, the second face S2, and the scraper 42, respectively. The controller 50 switches the heating actions by the first face heater 4511, the second face heater 4512, and the scraper heater 452 based on the temperatures detected by the temperature detector 46 so that the first face S1, the second face S2, and the scraper 42 falls within the above-described temperature range. The switching of the heating actions may be simply between on and off, or stepwise, and a pulse-width modulation (PWM) control may be used in on/off switching at a high frequency. The switching of the heating actions by the first face heater 4511, the second face heater 4512, and the scraper heater 452 by the controller 50 is independent of one another.

The temperature detector 46 detects temperatures of the first face S1, the second face S2, and the scraper 42, or temperatures corresponding to those and outputs the temperatures to the controller 50.

The conveyance driver 61 supplies a drive signal to a conveyance drum motor of the conveyance drum 21 based on a control signal from the controller 50 so as to rotate the conveyance drum 21 at a predetermined speed and timing. The conveyance driver 61 supplies a drive signal to a motor for driving the medium feeder 12, the hand-over unit 22 and the deliverer 26 based on a control signal of the controller 50 so as to feed or eject the recording medium M to or from the conveyance drum 21.

The carriage mover 62 outputs a drive signal to a motor or a brake of a moving mechanism that moves the carriage 24*a* of the head unit 24 based on a control signal from the controller 50, and moves the carriage 24*a* between the image-recording position and the purge maintenance position as described above.

The operation/display interface 63 displays the status of the inkjet recording device 1 and the operation menu according to a control signal from the controller 50, and outputs received user operations to the controller 50 The operation/display interface 63 includes a liquid crystal display with a touch sensor as an operation receiving means being overlaid on a display screen as a display means. A screen to prompt users to dispose ink when the ink in the ink storage 43 exceeds a predetermined amount is shown on the display screen of the operation/display interface 63.

The communication unit 64 is a communication interface that controls communication with an external device(s). One or more LAN boards or LAN cards, for example, are included as the communication interface in accordance with various communication protocols. The controller 64 obtains image data to be recorded from an external device(s) based on the control of the controller 50, and sends the status information and the like to the external device(s).

The bus 65 is a path for electrically connecting the above-described components to exchange signals.

Next, modification examples of the above-described embodiment are described. In each modification example, differences from the above-described embodiment are described in detail and features common to those in the above-described embodiment are omitted from description.

Modification Example 1

Figure 12:
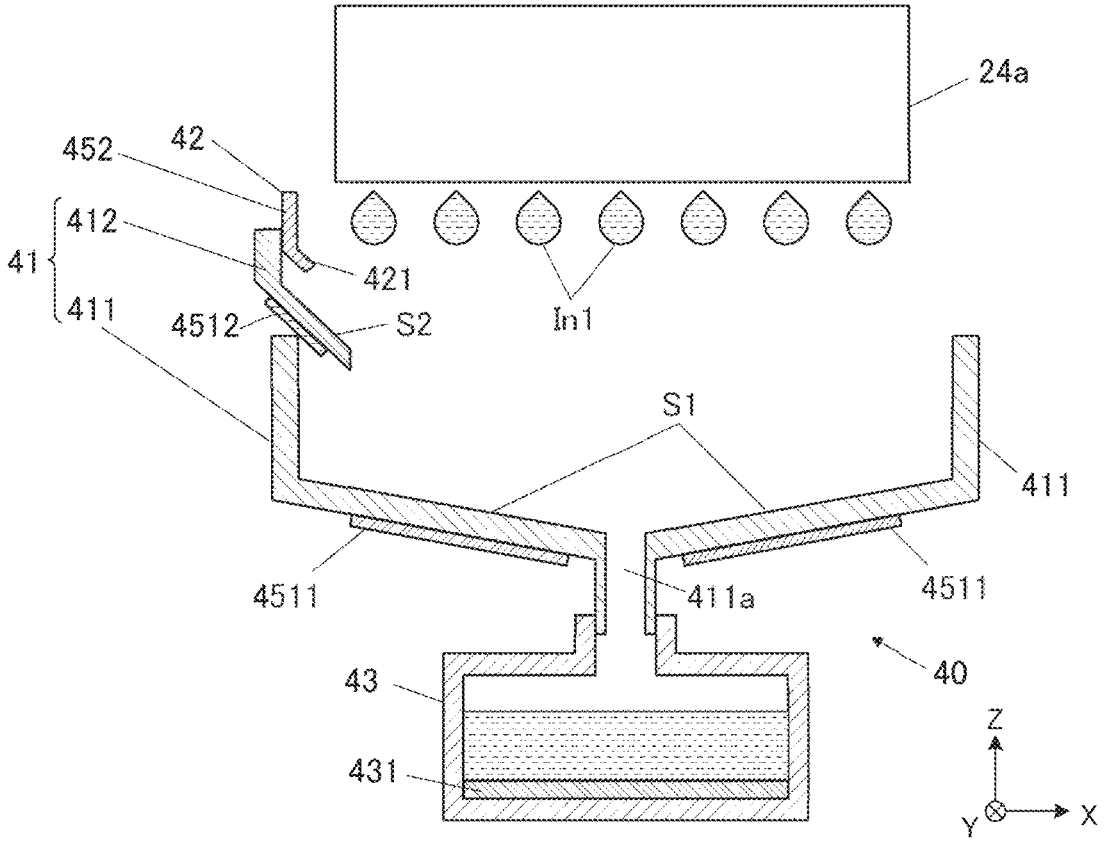
FIG. 12 shows a cross-sectional view of a configuration of the cleaner in Modification Example 1.

FIG. 12 shows a cross-sectional view of a configuration of the cleaner 40 in Modification Example 1.

The cleaner 40 in this modification example includes an ink sub-receiver 412 with a second face S2 that receives the scraped ink In2 separately from the ink tray 411. A scraper 42 is attached to an upper end of the ink sub-receiver 412. The second face S2 of the ink sub-receiver 412 is inclined at an angle θ2 with respect to the horizontal plane as in the above-described embodiment. A second heater 4512 that performs a heating action to heat the second face S2 on the other side of the second face S2 of the ink sub-receiver 412.

Figure 13:
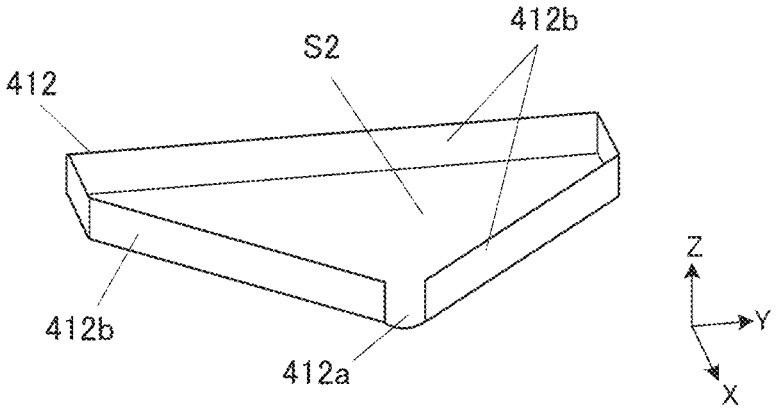
FIG. 13 shows a perspective view of an ink sub-receiver.

FIG. 13 shows a perspective view of the ink sub-receiver 412.

The ink sub-receiver 412 has the second face S2 that receives the scraped ink In2 and side walls 412*b* that surrounds the second face S2. The second face S2 is in a shape whose width in the Y direction is narrower toward the lower side. An outlet 412*a* through which ink is dropped is arranged between the side walls 412*b* at the lower end of the second face S2. In other words, the side walls 412*b* are arranged so as to surround the peripheral of the second face S2 excluding the outlet 412*a*.

The scraped ink In2 which is scraped off by the scraper 42 and dropped on the ink sub-receiver 412 flows on the second face S2 downward and is guided by the side walls 412*b* to gather toward the outlet 412*a*. The ink then is dropped through the outlet 412 to the ink tray 411.

As shown in FIG. 12, the ink sub-receiver 412 is arranged at the upper end of the side wall in the −X direction of the ink tray 411.

The entire bottom surface of the ink tray 411 in this modification example is inclined at an angle θ1 with respect to the horizontal plane.

Here, the scraped ink In2 dropped from the ink sub-receiver 412 to the first face S1 of the ink tray 411 gathers at the outlet 412*a* as described above. This makes it possible to make the amount per unit area of the scraped ink In2 dropped on the first face S1 equal to or greater than the amount of the ejected ink In1 in the purge maintenance. The ink thereby does not remain on the first face S1 but flows downward.

Figure 14:
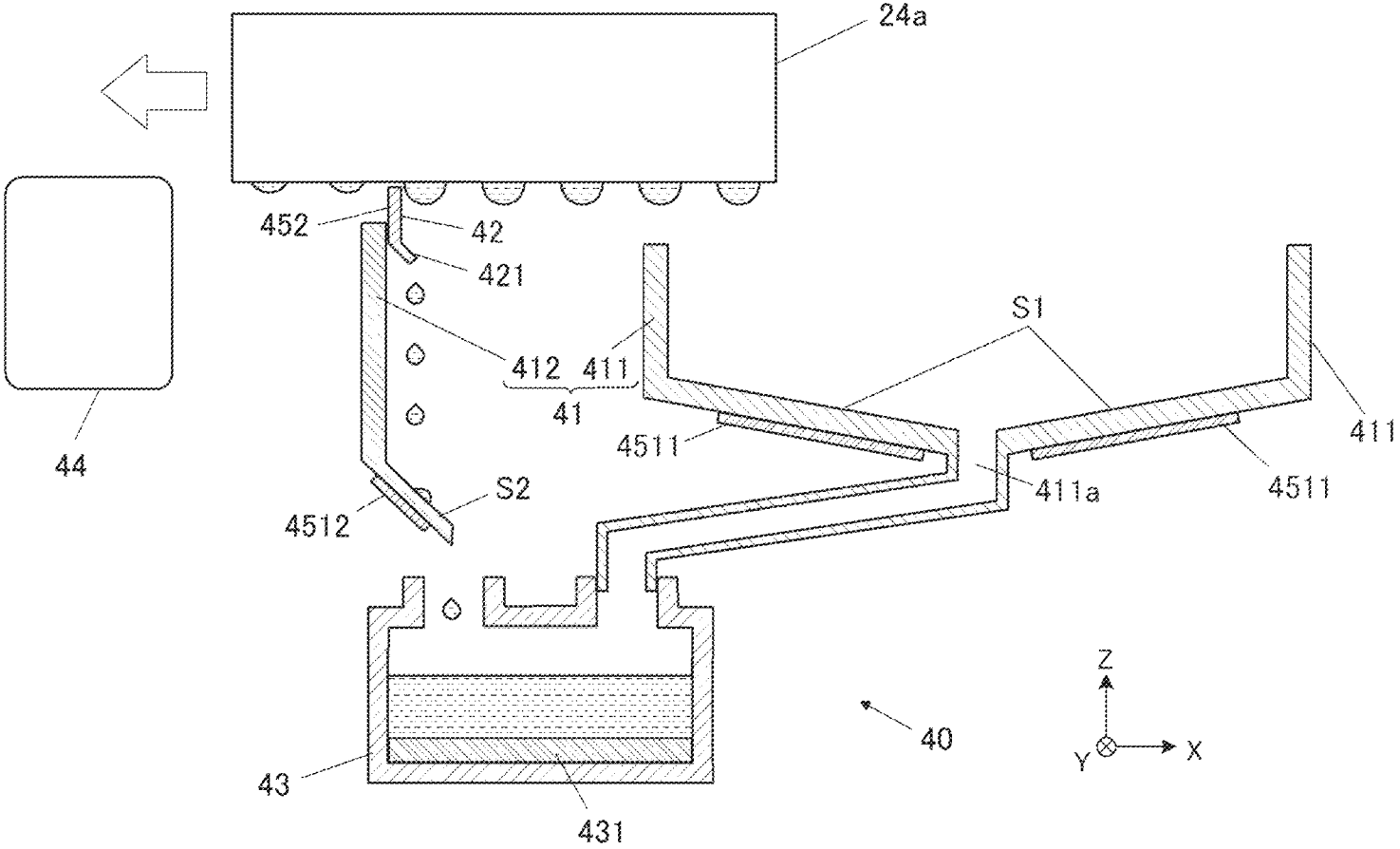
FIG. 14 shows a cross-sectional view of another example of a configuration of the cleaner in Modification Example 1.

FIG. 14 shows a cross-sectional view of another example of a configuration of the cleaner 40 in Modification Example 1.

In the cleaner 40 in FIG. 14, the scraped ink In2 dropped from the ink sub-receiver 412 directly enters the ink storage 43 without passing through the ink tray 411. This makes it possible to reliably prevent the ink dropped from the ink sub-receiver 412 from remaining on the first face S1 of the ink tray 411.

As the ink sub-receiver 412 is provided separately from the ink tray 411 as shown in FIGS. 12 and 14, the materials and temperatures of the ink tray 411 and the ink sub-receiver 412 and the inclination angles of the first face S1 and the second face S2 can be adjusted independently. The flowability of ink on the first face S1 and the second face S2 can be thereby adjusted individually.

Further, with a moving means to move the ink tray 411 independently from the ink sub-receiver 412, for example, the purge maintenance can be performed by the nozzles N facing the ink tray 411 while a small ink tray 411 is moved along the nozzle face 241*a* of the carriage 24*a*.

Modification Example 2

Figure 15:
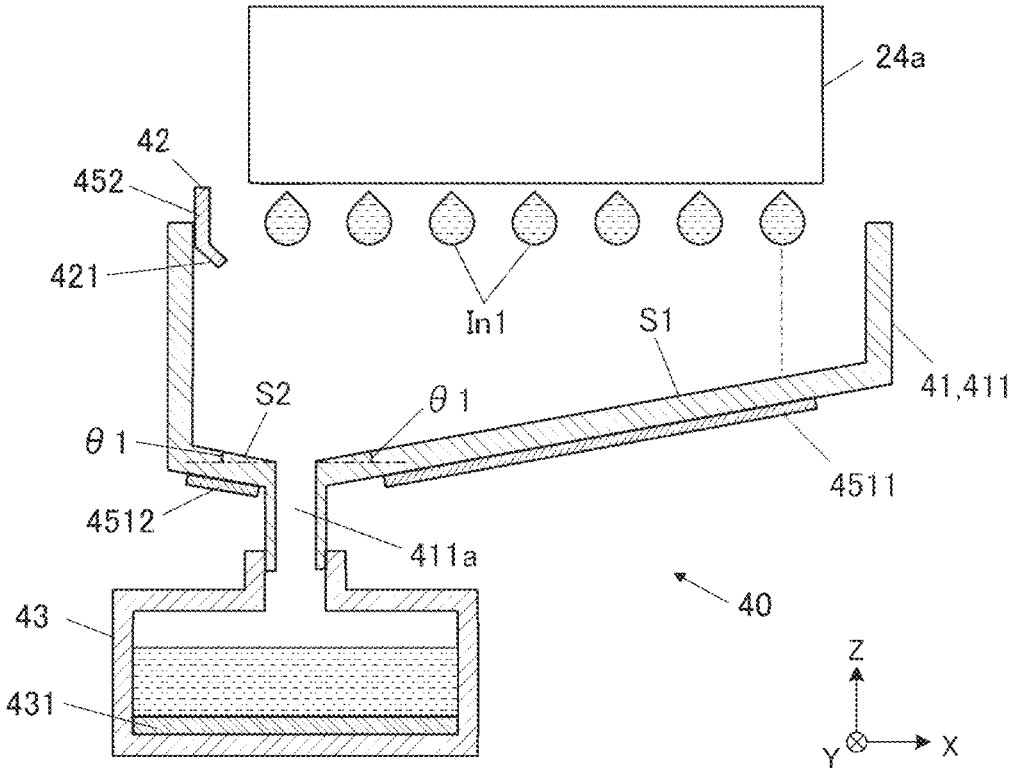
FIG. 15 shows a cross-sectional view of a configuration of the cleaner in Modification Example 2.

FIG. 15 shows a cross-sectional view of a configuration of the cleaner 40 in Modification Example 2.

In the above-described embodiment, the inclination angle of the second face S2 is larger than that of the first face S1. However, as the flowability of ink on the second face S2 is greater than that on the first face S1, the inclination angles on the first face S1 and the second face S2 may be equal (θ1 in this example) as shown in FIG. 15. The following methods (1) to (3) can be used as a method of making the flowability of ink on the second face S2 comparatively high.

(1) Method of making the surface roughness of the second face S2 smaller than that of the first face S1

(2) Method of making the second face S2 more repellent to ink than the first face S1

(3) Method of heating the second face S2 to a higher temperature compared to the first face S1

(1) Method of Making the Surface Roughness of the Second Face S2 Smaller than that of the First Face S1

In this method, the second face S2 is formed of a material with a surface roughness smaller than that of the first face S1, for example. Alternatively, the second face 2 may be polished to decrease the surface roughness, or the second face S2 may be finished with a protective film with a surface roughness smaller than that of the first face S1 on its surface.

An arithmetic mean roughness Ra may be used as an index of the surface roughness, for example.

(2) Method of Making the Second Face S2 More Repellent to Ink than the First Face S1

In this method, for example, the second face S2 is made of a material more repellent to ink than the material of the first face S1. The second face S2 may be finished with a protective film more repellent to ink than the first face S1 (ex. a resin film containing fluorine) on its surface.

(3) Method of Heating the Second Face S2 to a Higher Temperature Compared to the First Face S1

In this method, the controller 50 sends a control signal to the first face heater 4511 and the second heater 4512 so that the heating temperature in the heating action of the second face heater 4512 is higher than that of the first face heater 4511. Alternatively, if the ejected ink In1 can flow on the first face S1 without the first face S1 being heated, the action of heating the second face of the second face heater 4512 may be done exclusively. The second face heater 4512 may heat only a part of the second face S2 where the scraped ink In2 touches.

Two or more of the methods (1) to (3) described above may be used in combination.

One or more of the methods (1) to (3) may be applied to the above-described embodiment in which the inclination angle of the second face S2 is larger than the inclination angle of the first face S1.

As described hereinbefore, the maintenance device 2 in the present embodiment includes the scraper 42 that scrapes ink attaching onto the nozzle face 241*a*, and the ink receiver 41 that receives the ejected ink In1 ejected from the nozzles N and the scraped ink In2 scraped off by the scraper 42. The ink receiver 41 includes the first face S1 and the second face S2 that are inclined with respect to the horizontal plane, and receives the ejected ink In1 on at least the first face S1 of the first and second faces S1 and S2 and the scraped ink In2 on the second face S2. The flowability of ink on the second face S2 is greater than that on the first face S1.

According to this configuration, when a small amount of the scraped ink In2 is dropped on the second face S2, the scraped ink In2 can flow downward almost without remainder because of a high flowability of ink on the second face S2. Thus, it is possible to suppress occurrence of errors caused by the remaining ink such as contamination inside the machine of the inkjet recording device 1 and noticeable ink odor.

The inclination angle θ2 of the second face S2 with respect to the horizontal plane is larger than the inclination angle θ1 of the first face S1 with respect to the horizontal plane. This makes it possible to easily make the flowability of ink on the second face S2 higher than that on the first face S1.

The maximum value L2 of the length of the flow path of the scraped ink In2 on the second face S2 is smaller than the maximum value L1 of the length of the flow path of the ejected ink In1 on the first face S1. This makes it possible to suppress occurrence of a problem of the scraped ink In2 remaining on the second face S2.

The ink receiver 41 receives the ejected ink In1 on the first face S1 and the second face S2. As the ejected ink In1 is received on the first face S1 and the second face S2 in the purge maintenance as this, it is possible to make the cleaner 40 smaller compared to the configuration in which the ejected ink In1 is received only on the first face S1.

The ink receiver 41 includes the ink tray 411 with the first face S1 and the second face S2. This makes it possible to receive and gather the ejected ink In1 and the scraped ink In2 commonly by the ink tray 411.

The scraper 42 is attached to the ink tray 411. This makes it possible to cause the scraped ink In1 to fall onto a predetermined spot on the second face S2 from the scraper 42.

The ink receiver 41 according to Modification Example 1 includes the ink tray 411 with the first face S1, the ink sub-receiver 412 with the second face S2. The ink sub-receiver 412 includes the outlet 412*a* through which the scraped ink In2 that has flown and gathered on the second face S2 flows out, and is arranged at the spot where the scraped ink In2 flowing through the outlet 412*a* is dropped on the first face S1 of the ink tray 411.

This makes it possible to adjust the materials and temperatures of the ink tray 411 and the ink sub-receiver 412 and the inclination angles of the first face S1 and the second face S2 independently. And it is thereby possible to easily adjust the flowability of ink on the first face S1 and the second face S2 individually. As the ink tray 411 does not have the second face S2 with a large inclination angle, it is possible to make the ink tray 411 smaller, and to move the ink tray 411 independently.

By causing the scraped ink In2 to gather and fall through the outlet 412*a*, it is possible to make the amount per unit area of the scraped ink In2 dropped on the first face S1 equal to or larger than the amount of the ejected ink In1 in the purge maintenance. This makes it possible to cause the scraped ink In2 dropped on the first face S1 of the ink tray 411 from the ink sub-receiver 412 to smoothly flow downward.

The ink receiver 41 includes the outlet 411*a* to which the ink that has flown on the first face S1 and the second face S2 flows in, and the maintenance device 2 includes the ink storage 43 that stores ink that flows through the outlet 411*a*. This makes it possible to store the ejected ink In11 and the scraped ink In2 temporarily for a period corresponding to the capacity of the ink storage 43.

The outlet 411*a* is arranged within the half of the ink tray 411 on the side with the scraper 42 (the −X direction in the direction of the relative movement of the nozzle face 241 and the scraper 42 scraping off the ink adhering to the nozzle face 241*a* (the X direction). This makes it possible to make the inclination angle θ2 of the second face S2 to be larger than the inclination angle θ1 of the first face S1 while suppressing the height H of the ink tray 411. It is also possible to make the maximum value L2 of the length of the flow path of the scraped ink In2 on the second face S2 smaller than the maximum value 1 of the length of the flow path of the ejected ink In1 on the first face S1.

The maintenance device 2 include the ink amount detector 431 that detects the ink amount stored in the ink storage 43. This makes it possible to notify users before the ink storage 43 is full of ink.

As the surface roughness of the second face S2 is smaller than that of the first face S1, the flowability of ink on the second face S2 can be increased.

As the second face S2 is more repellent to ink than the first face S1, it is possible to improve the flowability of ink on the second face S2.

The maintenance device 2 includes the first face heater 4511 and the second face heater 4512 as a first heater that performs the heating action to heat at least the second face S2 of the first face S1 and the second face S2. This makes it possible to decrease the viscosity of ink dropped on the second face S2 and make the ink flow more easily.

As the heating temperature in the heating action is smaller than both the temperature at which ink is thermally cured and the maximum temperature that keeps the ink odor within a predetermined allowable range, it is possible to suppress occurrence of problems such as: thermally cured ink remaining on the first face S1 or the second face S2; and ink odor exceeding an allowable limit.

The ink has a property of changing its phase between a gel state and a sol state, and the heating temperature in the heating action is equal to or higher than the solidification temperature of the ink. This makes it possible to keep the ink dropped on the first face S1 and the second face S2 in the sol-state and maintain its flowability, suppressing occurrence of the problem of ink remainder on the first face S1 and the second face S2.

The scraper 42 transmits the ink adhering to the nozzle face 241*a* along itself without touching the nozzle face 241*a* scrapes the ink off. This makes it possible to scrape ink off of the nozzle face 241 without damaging the nozzle face 241*a*.

The scraper 42 scrapes off the ink ejected from the nozzles N and adhering to the nozzle face 241*a*. This makes it possible to effectively clean the nozzle face 241*a* after the purge maintenance.

The maintenance device 2 includes the receiving arm 421 that transmits the scraped ink In2 scraped by the scraper 42 along the receiving arm 421 and causes the ink In2 to fall onto a predetermined spot on the second face S2. With the receiving arm 421, it is possible to cause the ink scraped by the scraper 42 to directly fall on the second face S2 without adhering to the side walls of the ink tray 411. If the ink adheres to the side walls, the ink is cooled and solidified to be fixed, but the receiving arm 421 can prevent such a problem from occurring.

The maintenance device 2 includes the scraper heater 452 as the second heater that heats the scraper 42. This makes it possible to decrease the viscosity of the ink transmitted along the scraper 42 and make the ink flow more easily.

The maintenance device 2 includes the ink absorber 44 that absorbs ink remaining on the nozzle face 241*a* without being scraped off by the scraper 42. This makes it possible to more effectively clean the nozzle face 241*a*.

The inkjet recording device 1 according to the present embodiment includes the recording head 241 with the nozzle face 241 on which the openings of the nozzles N through which ink is discharged, and the maintenance device 2. This can make it harder for ink to remain in the ink receiver 41 of the maintenance device 2. Thus, it is possible to suppress occurrence of errors caused by the remaining ink such as contamination inside the machine of the inkjet recording device 1 and noticeable ink odor.

The present invention is not limited to the above embodiment and each modification example, and various changes can be made.

For example, the scraper 42 transmits ink along itself and scrapes ink off without contacting the nozzle face 241*a* in the above-described embodiment, but the present invention is not limited to this example. The scraper 42 may scrapes ink on the nozzle face 241*a* in contact with the nozzle face 241*a*.

In the above-described embodiment, the inkjet recording device 1 heats the ink to a sol-state and discharges the ink, and the ink is in a gel-state at a room temperature and is heated to be in a sol-state. However, the present invention is not limited to this example, and various kinds of known ink can be used such as ink that is in a sol or liquid phase at a room temperature.

In the above-described embodiment, the recording medium M is conveyed by the conveying drum 21, but the present invention is not limited to this example. For example, the recording medium M can be conveyed by the conveyance belt that is supported by the multiple rollers and moved according to the rotation of the rollers.

The above-described embodiment illustrates the single-path inkjet recording device 1 as an example. However, the present invention may be applied to an inkjet recording device that records an image by scanning a recording head.

While the present invention is described with some embodiments, the scope of the present invention is not limited to the above-described embodiment but encompasses the scope of the invention recited in the claims and the equivalent thereof.

What is claimed is:

1. A maintenance device that performs maintenance of a recording head with a nozzle face on which an opening of a nozzle for ink discharge is provided, the maintenance device comprising:

a scraper that scrapes ink that adheres to the nozzle face; and an ink receiver that receives ejected ink that is ejected through the nozzle and scraped ink that is scraped off by the scraper, wherein the ink receiver includes a first face and a second face that are each inclined with respect to a horizontal plane, wherein the ink receiver is configured to receives the ejected ink at least on the first face of the first face and the second face, and is configured to receive the scraped ink on the second face, wherein a flowability of ink on the second face is greater than a flowability of ink on the first face.

2. The maintenance device according to claim 1, wherein an inclination angle of the second face with respect to the horizontal plane is larger than an inclination angle of the first face with respect to the horizontal plane.

3. The maintenance device according to claim 1, wherein a maximum value of a length of a flow path of the scraped ink on the second face is smaller than a maximum value of a length of a flow path of the ejected ink on the first face.

4. The maintenance device according to claim 1, wherein the ink receiver receives the ejected ink on the first face and the second face.

5. The maintenance device according to claim 1, wherein the ink receiver comprises an ink tray including the first face and the second face.

6. The maintenance device according to claim 5, wherein the scraper is attached to the ink tray.

7. The maintenance device according to claim 1, wherein the ink receiver comprises an ink tray with the first face and an ink sub-receiver with the second face, wherein the ink sub-receiver includes an outlet through which the scraped ink that has flown and gathered on the second face flows out, wherein the ink sub-receiver is arranged at a position where the scraped ink flowing out through the outlet is dropped on the first face of the ink tray.

8. The maintenance device according to claim 1, wherein the ink receiver includes an outlet into which ink that has flown on the first face and on the second face flows, wherein the maintenance device includes an ink storage that stores the ink that flows into the outlet.

9. The maintenance device according to claim 8, further comprising:

an ink amount detector that detects an amount of ink stored in the ink storage.

10. The maintenance device according to claim 1, wherein the second face is more repellent to ink than the first face is.

11. The maintenance device according to claim 1, further comprising:

a first heater that performs a heating action to heat at least the second face of the first face and the second face.

12. The maintenance device according to claim 1, wherein a heating temperature in the heating action is lower than a temperature at which ink is thermally cured and a maximum temperature that keeps ink odor within a predetermined allowable range.

13. The maintenance device according to claim 11, wherein ink used in the maintenance device has a property of changing its phase between a gel state and a sol state, wherein a heating temperature in the heating action is equal to or higher than a solidification temperature of the ink.

14. The maintenance device according to claim 1, wherein the scraper scrapes ink adhering to the nozzle face by transmitting the ink along the scraper itself without contacting the nozzle face.

15. The maintenance device according to claim 1, wherein the scraper scrapes ink ejected from the nozzle and adhering to the nozzle face.

16. The maintenance device according to claim 1, further comprising:

a receiving arm that transmits the scraped ink scraped by the scraper along the receiving arm itself and drops the scraped ink at a predetermined spot on the second face.

17. The maintenance device according to claim 1, further comprising:

a second heater that heats the scraper.

18. The maintenance device according to claim 1, further comprising:

an ink absorber that absorbs ink not scraped by the scraper and remaining on the nozzle face.

19. An inkjet recording device comprising:

a recording head with a nozzle face on which an opening of a nozzle for ink discharge is provided; and the maintenance device according to claim 1.

20. A maintenance device that performs maintenance of a recording head with a nozzle face on which an opening of a nozzle for ink discharge is provided, the maintenance device comprising:

a scraper that scrapes ink that adheres to the nozzle face; and an ink receiver that receives ejected ink that is ejected through the nozzle and scraped ink that is scraped off by the scraper, wherein the ink receiver includes a first face and a second face that are each inclined with respect to a horizontal plane, wherein the ink receiver is configured to receives the ejected ink at least on the first face of the first face and the second face, and is configured to receives the scraped ink on the second face, wherein a flowability of ink on the second face is greater than a flowability of ink on the first face;

wherein the ink receiver comprises an ink tray including the first face and the second face;

wherein the ink tray includes an outlet which ink that has flown on the first face and the second face flows into, wherein the maintenance device includes an ink storage that stores the ink that flows into the outlet, wherein the outlet is arranged within a half of the ink tray on a side with the scraper in a direction of a relative movement of the nozzle face and the scraper that is scraping off the ink adhering to the nozzle face.

21. A maintenance device that performs maintenance of a recording head with a nozzle face on which an opening of a nozzle for ink discharge is provided, the maintenance device comprising:

a scraper that scrapes ink that adheres to the nozzle face; and an ink receiver that receives ejected ink that is ejected through the nozzle and scraped ink that is scraped off by the scraper, wherein the ink receiver includes a first face and a second face that are each inclined with respect to a horizontal plane, wherein the ink receiver is configured to receives the ejected ink at least on the first face of the first face and the second face, and is configured to receives the scraped ink on the second face, wherein a flowability of ink on the second face is greater than a flowability of ink on the first face;

wherein a surface roughness of the second face is smaller than a surface roughness of the first face.

* * * * *